US005921165A

United States Patent [19]

Takahashi et al.

[11] Patent Number: 5,921,165

[45] Date of Patent: Jul. 13, 1999

[54] HYDRAULIC CONTROL SYSTEM

[75] Inventors: Kinya Takahashi, Tsuchiura; Yusaku Nozawa, Ibaraki-ken; Nobuhiko Ichiki, Ibaraki-ken; Wataru Otsu, Ibaraki-ken; Hiroshi Matsuzaki, Tsukuba, all of Japan

[73] Assignee: Hitachi Construction Machinery Co., Ltd., Tokyo, Japan

[21] Appl. No.: 09/011,555

[22] PCT Filed: Aug. 5, 1997

[86] PCT No.: PCT/JP97/02713

§ 371 Date: Feb. 10, 1998

§ 102(e) Date: Feb. 10, 1998

[87] PCT Pub. No.: WO98/06949

PCT Pub. Date: Feb. 19, 1998

[30] Foreign Application Priority Data

Aug. 8, 1996 [JP] Japan ..... 8-209835

[51] Int. Cl.[6] ..... F15B 11/08

[52] U.S. Cl. ..... 91/426; 91/447; 91/461; 91/465

[58] Field of Search ..... 91/426, 446, 447, 91/448, 435, 461, 462, 465

[56] References Cited

U.S. PATENT DOCUMENTS

| | | | |
|---|---|---|---|
| 2,864,402 | 12/1958 | Presnell | 91/426 X |
| 2,925,782 | 2/1960 | Sharpe et al. | 91/426 X |
| 3,465,649 | 9/1969 | Eggers et al. | 91/426 |
| 3,515,032 | 6/1970 | Dezelan et al. | 91/426 X |
| 4,154,262 | 5/1979 | Blume et al. | 91/426 X |
| 4,913,190 | 4/1990 | Kugler | 91/426 X |

FOREIGN PATENT DOCUMENTS

| | | |
|---|---|---|
| 1-158802 | 11/1989 | Japan . |
| 3-249411 | 11/1991 | Japan . |
| 4-157205 | 5/1992 | Japan . |
| 5-26206 | 2/1993 | Japan . |
| 6-207604 | 7/1994 | Japan . |
| 7-47604 | 11/1995 | Japan . |

*Primary Examiner*—Hoang Nguyen
*Attorney, Agent, or Firm*—Fay, Sharpe, Beall, Fagan, Minnich & McKee

[57] ABSTRACT

In a hydraulic control system including a valve device B for controlling a hydraulic fluid supplied from a hydraulic pump A to a hydraulic cylinder C, the valve device comprises a spool 16 slidably fitted into a valve body 1, and a non-leak valve 27 for controlling communication of an actuator passage 19. The non-leak valve comprises a main valve section 40 including a seat valve 41 provided in the valve body, and a pilot control section 60 including a pilot poppet valve 61 provided in an end cover 31. The seat valve is controlled in proportion to an opening of the pilot poppet valve, and a relief valve 55 for preventing the hydraulic cylinder from being subject to an overload is built in the seat valve. The non-leak valve thus fulfills a load holding function and an overload relief function. By arranging the non-leak valve and the spool in two lines, the valve device can be made more compact.

8 Claims, 11 Drawing Sheets

STATE OF HOLDING OF CYLINDER POSITION (NON-LEAK)

STATE OF HOLDING OF CYLINDER POSITION (NON-LEAK)

OPERATION UPON OVERLOAD OF CYLINDER (RELIEF)

OPERATION UPON NEGATIVE PRESSURE IN CYLINDER (MAKE-UP)

OPERATION UPON COTRACTION OF CYLINDER

OPERATION UPON EXTENSION OF CYLINDER

HYDRAULIC CONTROL SYSTEM

TECHNICAL FIELD

The present invention relates to a hydraulic control system for hydraulic machines such as hydraulic excavators, and more particularly to a hydraulic control system in which a non-leak valve for preventing internal leakage of a hydraulic fluid in the state of holding an actuator load is built in a valve device having a spool type directional control valve built therein.

BACKGROUND ART

In a hydraulic control system for hydraulic machines such as hydraulic excavators, a valve device having a spool type directional control valve built therein is used as means for switching over passages for a hydraulic fluid from a hydraulic pump and transmitting the hydraulic fluid to a target actuator. Such a valve device includes a spool slidably fitted to a spool bore formed in a valve body, and controls the flow rate and the flowing direction of the hydraulic fluid supplied from the hydraulic pump to the actuator when the spool is operated.

In the above valve device, an appropriate clearance is formed between the spool and the bore of the valve body so that the spool can slide in the bore. For the presence of the clearance, there occurs internal leakage at passage portions around the spool, particularly at a port portion communicating with the actuator. Where the actuator is a hydraulic cylinder for holding a high load, the internal leakage appears as a reduction in the load holding force. Specifically, if the load pressure of the hydraulic cylinder is enclosed at an actuator port portion around the spool, the hydraulic fluid internally leaks from an outer peripheral of the spool to a reservoir port, causing the hydraulic cylinder to move a little by a little with the elapse of time.

To cope with such a problem, a hydraulic control system including a non-leak valve built in a valve device is proposed in JP, Y, 7-47604.

In the valve device of the hydraulic control system proposed, a non-leak valve is disposed in an actuator passage formed in a valve body to interconnect an external actuator port connected to a hydraulic cylinder and an actuator port around the spool (i.e., an internal actuator port). The non-leak valve comprises a main valve section including a seat valve positioned in the actuator passage, and a pilot control section including a pilot poppet valve for controlling opening/closing of the seat valve of the main valve section. When the spool is in the neutral position, the seat valve is closed to minimize the amount of internal leakage. When the spool is operated, the pilot poppet valve of the pilot control section is opened in interlock with the movement of the spool to make open the seat valve of the main valve section.

Generally, an overload relief valve is incorporated in a valve device for use with a hydraulic cylinder for holding a high load so that when the hydraulic cylinder is subject to an overload, the overload relief valve is opened to release the hydraulic fluid under high pressure to a reservoir, thereby preventing the hydraulic cylinder from being damaged. The valve device described in JP, Y, 7-47604 also includes an overload relief valve disposed therein separately from the non-leak valve. Specifically, the non-leak valve is arranged in the valve body parallel to the spool, and the overload relief valve for preventing the actuator from experiencing an overload is arranged on the outer side of the non-leak valve parallel to the non-leak valve and the spool. Furthermore, the overload relief valve is usually added with a make-up function of replenishing the hydraulic fluid from the reservoir when the hydraulic fluid supplied to the actuator is subject to negative pressure.

In addition, JP, A, 3-249411 describes a load fall preventing valve device which is separate from a valve device including a spool built therein, and in which is built a non-leak valve having both a load holding function and an overload relief function.

DISCLOSURE OF THE INVENTION

With the hydraulic control system described in JP, Y, 7-47604, the provision of the non-leak valve reduces the amount of internal leakage in the valve device and improves the ability of holding the actuator load. This prior art however raises the following problems.

1. With the provision of the non-leak valve, the spool, the non-leak valve and the overload relief valve are arranged parallel to each other in three lines, resulting in a larger size of the valve body.

2. In a hydraulic machine such as a hydraulic excavator, there are employed a plurality of driven members such as a boom, an arm and a bucket, and a plurality of actuators corresponding to those driven members. A valve device also includes a plurality of spools. In the valve device including the plurality of spools built therein, however, the non-leak valve as disclosed in the above prior art is used in limited places. Usually, the non-leak valve is installed in particular actuator passages, e.g., actuator passages communicating with the bottom side of the boom cylinder and the rod side of an arm cylinder where the self-weight load tends to act on those cylinders in the neutral state. This means that the size of the valve body is determined from the arrangement including the non-leak valve which is installed in smaller number, and the valve body contains useless spaces in portions where the non-leak valves are not required to be installed.

In the load fall preventing valve device described in JP, A, 3-249411, one valve (non-leak valve) serves to develop both the load holding function and the overload relief function. However, the load fall preventing valve device is separate from the valve device including the spool built therein; namely, the valve device including the spool built therein is not in itself given with both the load holding function and the overload relief function. Accordingly, this prior art cannot be applied to make more compact a valve device which is resulted by imparting both the load holding function and the overload relief function to the valve device including the spool built therein.

An object of the present invention is to provide a hydraulic control system in which a valve device including a spool built therein can be constructed with a more compact size by imparting both a load holding function and an overload relief function to one valve, and arranging this valve parallel to a spool in two lines.

Features of the present invention to achieve the above object of the invention and associated features are as follows.

(1) First, the present invention provides a hydraulic control system comprising a hydraulic pump, a valve device for controlling a hydraulic fluid delivered from the hydraulic pump, and a hydraulic actuator driven by the hydraulic fluid delivered from the hydraulic pump and controlled by the valve device, the valve device comprising a valve body, a pump port and a pair of external actuator ports all formed in the valve body and connected respectively to the hydraulic pump and the actuator, a spool bore formed in the valve body, a pair of internal actuator ports and a pair of reservoir ports all formed in an inner circumferential surface of the spool bore, a pair of actuator passages for connecting respectively the pair of external actuator ports to the pair of internal actuator ports, a spool slidably fitted to the spool bore and switchingly controlling communication between the pump port and the pair of internal actuator ports, and a non-leak valve disposed in at least one of the pair of actuator passages in the valve body and controlling communication of the one actuator passage, the non-leak valve comprising a main valve section including a seat valve for dividing the one actuator passage into a first passage portion on the side of the external actuator port and a second passage portion on the side of the internal actuator port, and a pilot control section including a pilot poppet valve for controlling opening/closing of the seat valve of the main valve section, the pilot poppet valve of the pilot control section being opened in interlock relation when the spool is operated in a first direction to communicate the pump port with the internal actuator port positioned in the other of the pair of actuator passages, thereby opening the seat valve of the main valve section to establish communication between the first passage portion and the second passage portion of the one actuator passage, wherein the main valve section of the non-leak valve comprises proportional control means for controlling an opening of the seat valve in proportion to an opening of the pilot poppet valve, and relief control means for opening the seat valve when the pressure in the first passage portion of the one actuator passage exceeds a predetermined level, and the pilot control section of the non-leak valve comprises pilot operating means for increasing the opening of the pilot poppet valve depending on the stroke of the spool in the first direction, the spool being configured such that a communication passage including no meter-out variable throttle is established between the internal actuator port positioned on the side of the one actuator passage and the reservoir port adjacent to that internal actuator port when the spool is in a neutral position and when the spool is operated in the first direction.

The non-leak valve of the valve device provided in the hydraulic control system of the present invention constructed as set forth above fulfills various functions below.

1. Meter-Out Flow Rate Control Function

When the spool is operated in the first direction, the pilot operating means provided in the pilot control section of the non-leak valve increases the opening of the pilot poppet valve depending on the stroke of the spool in the first direction, and the proportional control means provided in the main valve section of the non-leak valve controls the opening of the seat valve in proportion to the opening of the pilot poppet valve, so that the seat valve has the opening corresponding to the stroke of the spool in the first direction. Also, when the spool is operated in the first direction, the internal actuator port positioned on the side of the one actuator passage and the reservoir port adjacent to that internal actuator port is merely communicated with each other through the communication passage.

As a result of that the opening of the seat valve is controlled and the communication passage is established as explained above, the hydraulic fluid returned from the hydraulic actuator is released to a reservoir via the internal actuator port, the communication passage and the reservoir port while passing through the actuator passage and being controlled in flow rate by the seat valve. Thus the non-leak valve performs meter-out flow rate control.

2. Function of Holding Load of Hydraulic Actuator

When the spool is in the neutral position, the non-leak valve holds the seat valve closed by virtue of the pilot operating means provided in the pilot control section and the proportional control means provided in the main valve section. Therefore, the communication between the outer actuator port and the inner actuator port is cut off by the non-leak valve. As a result, the load of the hydraulic actuator is held and the hydraulic actuator is maintained in the same position.

3. Function of Releasing Overload of Hydraulic Actuator

When the spool is in the neutral position and the hydraulic actuator is subject to an abnormal overload, the relief control means provided in the main valve section of the non-leak valve operates to open the seat valve when the pressure in the first passage portion of the one actuator passage exceeds the predetermined level. Also, when the spool is in the neutral position, the internal actuator port positioned on the side of the one actuator passage and the reservoir port adjacent to that internal actuator port is merely communicated with each other through the communication passage. Therefore, abnormal high pressure in the hydraulic pressure is released to the reservoir via the outer port, the actuator passage, the inner actuator port, the communication passage, and the reservoir port. As a result, the hydraulic actuator is prevented from being damaged.

Thus, with the valve device provided in the hydraulic control system of the present invention, the non-leak valve fulfills not only the meter-out flow rate control function, but also the load holding function and the overload relief function for the hydraulic actuator. By arranging the non-leak valve and the spool in two lines, the valve device can be made more compact.

(2) In the above (1), preferably, the proportional control means of the main valve section comprises a back pressure chamber for urging the seat valve in the closing direction, and a proportional control variable throttle provided in the seat valve for communicating the first passage portion of the one actuator passage with the back pressure chamber through a minimum opening when the seat valve is closed, and increasing the opening thereof depending on the stroke of the seat valve in the opening direction, the pilot poppet valve of the pilot control section controlling communication between the back pressure chamber and the low-pressure passage.

With such a feature that the proportional control means comprises the back pressure chamber and the proportional control variable throttle, and the pilot poppet valve of the pilot control section controls the communication between the back pressure chamber and the low-pressure passage, the meter-out flow rate control function and the load holding function stated in "1" and "2" of the above (1) can be achieved. Further, with the feature that the first passage portion of the one actuator passage is communicated with the back pressure chamber through the minimum opening when the seat valve is closed, the seat valve is opened by the pressure in the second passage portion of the one actuator passage when the spool is operated in a direction opposed to the first direction. This enables the hydraulic fluid to pass through the one actuator passage after being regulated by the spool under meter-in flow rate control.

Moreover, by utilizing a seat-valve position control function of the back pressure chamber explained in the following (3), the relief control means can be easily realized; hence the overload relief function for the hydraulic actuator stated in "3" of the above (1) can be achieved.

In addition, a make-up function can also be achieved in a negative pressure state of the hydraulic actuator.

More specifically, when the spool in the neutral position and the hydraulic actuator is subject to negative pressure, the back pressure chamber in the main valve section is also under negative pressure and the seat valve is opened. Also, when the spool is in the neutral position, the internal actuator port positioned on the side of the one actuator passage and the reservoir port adjacent to that internal actuator port is merely communicated with each other through the communication passage. Therefore, the hydraulic fluid is replenished to the hydraulic actuator under negative pressure from the reservoir via the reservoir port, the communication passage around the spool, the inner actuator port, the actuator passage, and the outer actuator.

(3) In the above (2), preferably, the relief control means comprises an inner passage formed in the interior of the seat valve for communicating the second passage portion of the one actuator passage with the back pressure chamber, a relief poppet valve disposed to open and close the inner passage, and an operating mechanism for holding the relief poppet valve in a closed position when the pressure in the first passage portion is lower than the predetermined level, and for opening the relief poppet valve when the pressure in the first passage portion exceeds the predetermined level.

With this feature, when the pressure in the first passage portion exceeds the predetermined level, the relief poppet valve is opened to communicate the back pressure chamber with the second passage portion through the inner passage, causing a pressure reduction in the back pressure chamber to thereby open the seat valve. Accordingly, as stated in "3" of the above (1), the overload relief function for the hydraulic actuator is developed. Thus, by utilizing the seat-valve position control function developed with the back pressure chamber, the overload relief function can be easily achieved.

(4) In the above (3), preferably, the operating mechanism of the relief control means comprises pistons built in the seat valve and driven by the pressure in the first passage portion to press the relief poppet valve in the opening direction, a relief spring disposed in a spring chamber, which is formed in the seat valve on the side opposite to the back pressure chamber, for normally urging the relief poppet valve in the closing direction against the pressing force of the pistons, and a shaft portion positioned between the relief poppet valve and one of the pistons, a space around the shaft portion constituting part of the inner passage.

With this feature, when the pressure in the first passage portion exceeds the predetermined level set by the relief spring, the one of the pistons is moved to open the relief poppet valve, as mentioned in the above (3).

(5) In the above (2), preferably, the pilot operating means of the pilot control section comprises pistons driven by pilot pressure for operating the spool in the first direction, thereby pressing the pilot poppet valve in the opening direction, a pilot spring disposed in a spring chamber, which is formed on the side opposite to the pistons, for normally urging the pilot poppet valve in the closing direction against the pressing force of the pistons, and a shaft portion for joining the pilot poppet valve and one of the pistons into a one-piece member, a space around the shaft portion being communicated with the back pressure chamber in the main valve section, the spring chamber being communicated with the low-pressure passage.

With this feature, when the pilot pressure for operating the spool in the first direction acts on the pistons, the pistons are driven by the pilot pressure to open the pilot poppet valve against the pilot spring. Further, as the pilot pressure rises, the stroke of the spool is increased and the driving force of the pistons is also increased, thus resulting an increased opening of the pilot poppet valve. In other words, the pilot operating means increases the opening of the pilot poppet valve depending on the stroke of the spool in the first direction.

Additionally, with the construction that the space around the shaft portion for joining the pilot poppet valve and one of the pistons into the one-piece member is communicated with the back pressure chamber in the main valve section, although the load pressure of the hydraulic actuator is introduced to the space around the shaft portion through the back pressure chamber in the state of holding the load of the hydraulic actuator as mentioned in "2" of the above (1), forces acting on the pilot poppet valve and one of the pistons due to the load pressure are balanced by each other. As a result, the pilot poppet valve and the load holding function is maintained.

(6) In the above (1), preferably, the hydraulic control system further comprises an end cover attached to an end of the valve body on the side of the one actuator passage and having a first pressure bearing chamber in which a spring for holding the spool in the neutral position is disposed and to which the pilot pressure for operating the spool in the first direction is introduced, wherein the pilot control section of the non-leak valve is built in the end cover, and the pilot operating means of the pilot control section includes a second pressure bearing chamber communicating with the first pressure bearing chamber and operating the pilot poppet valve.

With this feature, the pilot control section of the non-leak valve is built in the same end cover along with the spool operating spring and the first pressure bearing chamber. Therefore, only the main valve section of the non-leak valve is arranged on the valve body side and the valve body can be made more compact.

(7) In the above (1) or (6), preferably, the main valve section and the pilot control section of the non-leak valve are arranged in series to each other and parallel to the spool.

With this feature, the entirety of the non-leak valve, including the pilot control section, is arranged parallel to the spool in two lines; hence the valve device can be made more compact.

(8) In the above (1), preferably, the spool is configured such that a meter-out variable throttle is established between the internal actuator port positioned on the side of the other actuator passage and the reservoir port adjacent to that internal actuator port when the spool is operated in a second direction opposed to the first direction.

With this feature, when the spool is operated in the second direction, the hydraulic fluid returned from the hydraulic actuator is released to the reservoir via the external actuator port, the actuator passage, the internal actuator port and the meter-out variable throttle provided on the spool while being controlled in flow rate by the meter-out variable throttle, before passing through the reservoir port. Thus the meter-out flow rate control is performed in the same manner as in the conventional valve device.

BEST MODE FOR CARRYING OUT THE INVENTION

Hereunder, one embodiment of the present invention will be described with reference to the drawings.

First, the construction of a hydraulic control system according to one embodiment of the present invention will be described with reference to FIGS. 1 and 2.

Figure 1:
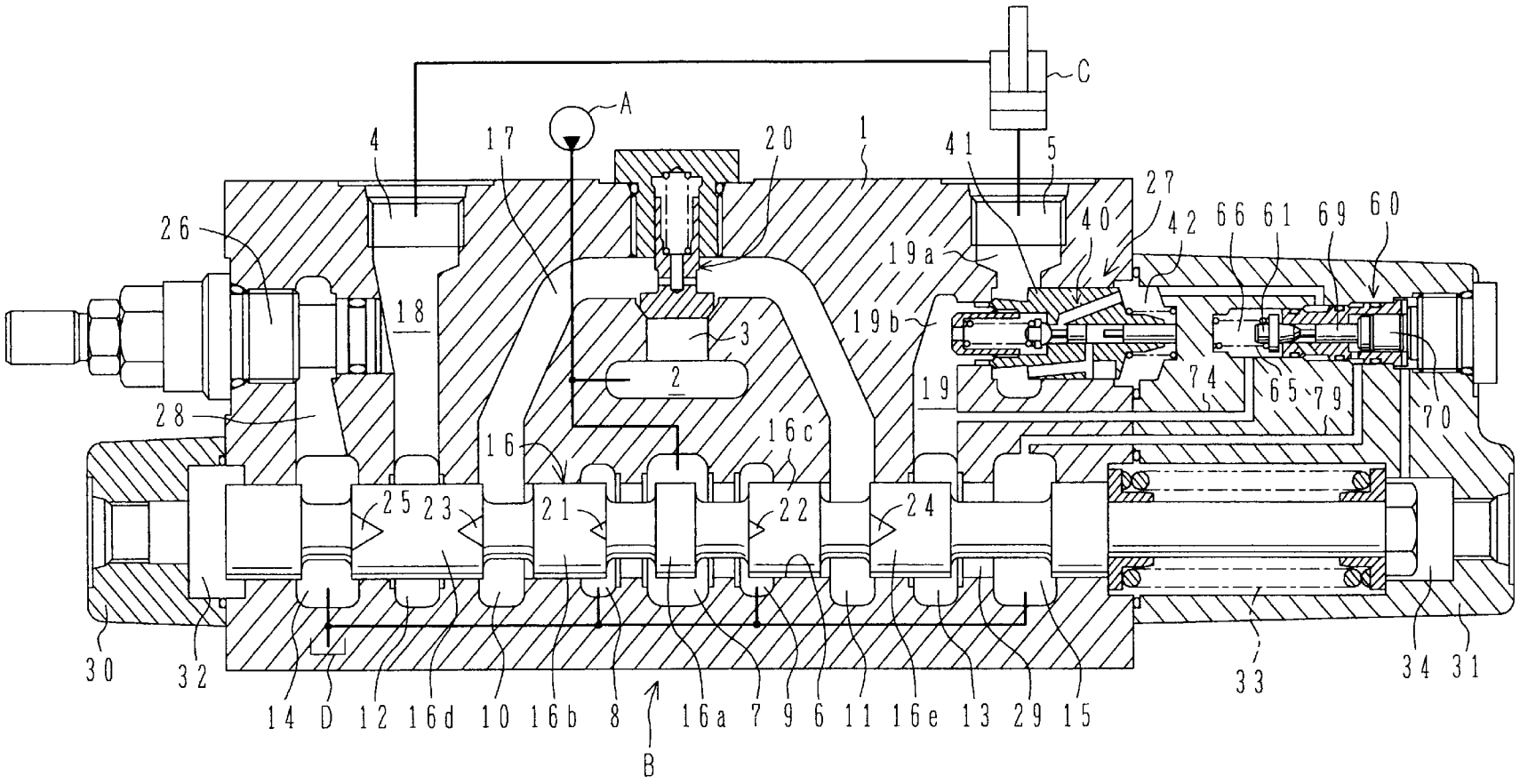
FIG. 1 is a view showing a hydraulic control system according to one embodiment of the present invention, the view being also depicted for explaining the operation of the hydraulic control system in a state of holding the position of a hydraulic cylinder.

In FIG. 1, the hydraulic control system of this embodiment comprises a hydraulic pump A, a valve device B for controlling a hydraulic fluid delivered from the hydraulic pump, and a plurality of actuators including a hydraulic cylinder C driven by the hydraulic fluid delivered from the hydraulic pump and controlled by the valve device B.

The valve device B has a valve body 1 in which there are formed a pump passage 2 connected to the hydraulic pump A and, as elements associated with the hydraulic cylinder C, a pump port 3 communicating with the pump passage 2, a pair of actuator ports 4, 5 connected respectively to the rod side and the bottom side of the hydraulic cylinder C, and a spool bore 6. Also, in an inner circumferential surface of the spool bore 6 of the valve body 1, there are formed an inlet side center bypass port 7 positioned in a central portion, a pair of outlet side center bypass ports 8, 9 positioned on both sides of the port 7 in symmetrical relation, a pair of meter-in ports 10, 11, a pair of actuator ports 12, 13, and a pair of reservoir ports 14, 15. A spool 16 is slidably fitted to the spool bore 6 for switchingly controlling the respective ports to open and close.

It is to be noted that, to discriminate the actuator ports 4, 5 connected to the hydraulic cylinder C and the actuator ports 12, 13 formed in the spool bore 6 from each other, the former is called external actuator ports and the latter is called internal actuator ports in the description of this application.

In the valve body 1, there are further formed a passage bridge 17 for connecting the pump port 3 to the meter-in ports 10, 11, and a pair of actuator passages 18, 19 for connecting the external actuator ports 4, 5 to the internal actuator ports 12, 13 respectively.

A load check valve 20 is disposed between the pump port 3 and the passage bridge 17. The load check valve 20 is to prevent the hydraulic fluid from the hydraulic cylinder C from flowing reversely.

Of the actuator passages 18, 19, the actuator passage 18 associated with the rod side of the hydraulic cylinder C includes an overload relief valve 26 disposed therein, and the actuator passage 19 associated with the bottom side of the hydraulic cylinder C includes a non-leak valve 27 disposed therein. The overload relief valve 26 is to prevent the rod side of the hydraulic cylinder C from being subject to an overload. Specifically, when the pressure on the rod side of the hydraulic cylinder C exceeds a predetermined level, the overload relief valve 26 is opened to communicate the actuator passage 18 with the reservoir port 14 via a passage 28, allowing the hydraulic fluid in the actuator passage 18 to escape into the reservoir. The non-leak valve 27 serves to fulfill later-described various functions, i.e., a leakage preventing function, an overload preventing function, a negative pressure making-up function, and a meter-out flow rate control function.

The spool 16 has lands (large-diameter portions) 16*a*, 16*b*, 16*c*, 16*d*, 16*e*. Notches 21, 22 serving as center bypass variable throttles are formed respectively in the lands 16*b*, 16*c* on the sides adjacent to the outlet side center bypass ports 8, 9, notches 23, 24 serving as meter-in variable throttles are formed respectively in the lands 16*d*, 16*e* on the sides adjacent to the meter-in ports 10, 11, and a notch 25 serving as a meter-out variable throttle is formed in the land 16*d* on the side adjacent to the reservoir port 14.

From the point of developing the above functions of the non-leak valve 27, the land 16*e* on the side of the internal actuator port 13 of the spool 16 has a shorter length than the land 16*d* on the opposite side to provide such a configuration that when the spool 16 is operated to the left as viewed in the drawing, a communication passage 29 including no meter-out variable throttle is established between the internal actuator port 13 and the reservoir port 15.

End covers 30, 31 are attached to both ends of the valve body 1. In the end cover 30, there is formed a pressure bearing chamber 32 to which is introduced pilot pressure acting to operate the spool 16 to the right as viewed in the drawing. In the end cover 31, there is built in a spring 33 for holding the spool 16 in the neutral position and there is formed a pressure bearing chamber 34 to which is introduced pilot pressure acting to operate the spool 16 to the left as viewed in the drawing.

The non-leak valve 27 comprises a main valve section 40 including a seat valve 41 for dividing the actuator passage 19 into a first passage portion 19*a* on the side of the external actuator port 5 and a second passage portion 19*b* on the side of the internal actuator port 13, and a pilot control section 60 including a pilot poppet valve 61 for controlling opening/closing of the seat valve 41 of the main valve section 40.

Additionally, the main valve section 40 and the pilot control section 60 of the non-leak valve 27 are arranged in series and are positioned, as a whole, parallel to the spool 16.

Details of the main valve section 40 and the pilot control section 60 of the non-leak valve 27 will now be described with reference to FIG. 2.

The main valve section 40 includes the seat valve 41 and a back pressure chamber 42 for urging the seat valve 41 in the direction to close. The seat valve 41 comprises a seat portion 41*a* and a support portion 41*b*. The seat portion 41*a* is positioned between an inlet port 43*a* constituting part of the first passage portion 19*a* and an outlet port 43*b* constituting part of the second passage portion 19*b* and lying parallel to the spool bore 6. The support portion 41*b* is slidably fitted to a bore 44 formed in the valve body 1 parallel to the spool bore 6. Thus, the seat valve 41 is arranged in its entirety parallel to the spool bore 6.

The seat portion 41*a* is tubular in shape and has, on the side of the outlet port 43*b*, an extended portion in which a metering orifice 41*c* with a predetermined slit width is formed. When the seat portion 41*a* is held in contact with a valve seat 41*d*, the communication between the inlet port 43*a* and the outlet port 43*b* is cut off, and when the seat portion 41*a* moves away from the valve seat 41*d*, the inlet port 43*a* is communicated with the outlet port 43*b* through the metering orifice 41*c*. A sleeve 50 is inserted in an opening formed in the seat portion 41*a* on the side adjacent to the second passage portion 19*b*, and cooperates with the opening in the seat portion 41*a* to define a spring chamber 52 in which a relief spring 51 (described later) is disposed.

The support portion 41*b* has formed therein a passage 45*a* being open to the inlet port 43*a*, and a slit 46 communicating with the passage 45*a* and being open to the back pressure chamber 42. The slit 46 constitutes a proportional control variable throttle 47 in cooperation with an inner circumferential surface of the bore 44 in the valve body 1. The variable throttle 47 communicates the inlet port 43*a* (the first passage portion 19*a*) with the back pressure chamber 42 through a minimum opening when the seat valve 41 is closed, and increases its opening depending on the stroke of the seat valve 41 in the opening direction thereof. A spring 48 for holding the seat portion 41*a* of the seat valve 41 in the closed position is disposed in the back pressure chamber 42.

The support portion 41*b* also has formed therein a central hole 53 penetrating the support portion 41*b* in the axial direction, and an oblique hole 54 having one end made open to the central hole 53 in a position near an opening of the central hole 53 on the side adjacent to the spring chamber 52 and the other end made open to the back pressure chamber 42. A valve seat 55*a* with which a relief poppet valve 55 comes into contact is formed at an opening end of the central hole 53 on the side adjacent to the spring chamber 52, and the relief poppet valve 55 is pressed by the relief spring 51 to be held against the set valve 55*a*. The opening of the central hole 53 on the side adjacent to the spring chamber 52 and the oblique hole 54 cooperatively constitute an inner passage 56 for communicating the second passage portion 19*b* with the back pressure chamber 42. The relief poppet valve 55 is arranged so as to open and close the inner passage 56.

Further, pistons 57, 58 having small-diameter shaft portions 57*a*, 58*a*, respectively, are slidably fitted to the central hole 53 of the support portion 41*b*. The piston 57 is arranged such that the small-diameter shaft portion 57*a* is held in abutment with the poppet valve 55. The piston 58 is arranged such that the small-diameter shaft portion 58*a* extends toward the side of the piston 57 and its end on the side opposite to the small-diameter shaft portion projects into the back pressure chamber 42 beyond an end surface of the support portion 41*b* to such an extent as coming into abutment with a back pressure chamber wall surface 42*a* formed in the end cover 31. A space around the small-diameter shaft portion 57*a* of the piston 57 is utilized as part of the inner passage 56, and a cylinder chamber 59 is defined between the piston 57 and the piston 58. The cylinder chamber 59 is communicated with the passage 45*a* through a passage 45*b*.

With the above construction, the pistons 57, 58 are driven by the pressure in the first passage portion 19*a* to press the relief poppet valve 55 in the direction to open. On the other hand, the relief spring 51 disposed in the spring chamber 52 normally urges the relief poppet valve 55 in the direction to close against the pressing force of the piston 57. A operating mechanism for the relief poppet valve is thereby constructed such that when the pressure in the first passage portion 19*a* is lower than a predetermined level set by the spring 51, the relief poppet valve 55 is held in the closed position, and when that pressure exceeds the predetermined level, the relief poppet valve 55 is opened.

The pilot control section 60 comprises a bore 62 formed in the end cover 31 in series (coaxially) with the bore 44 for the seat valve 41 and parallel to the spool bore 6, and a sleeve 64 inserted in the bore 62 and fixedly held by a threaded plug 63. A spring chamber 66 is defined in the bore 62 on the side of the sleeve 64 opposite to the plug 63 with a pilot spring 65 disposed in the spring chamber 66. The sleeve 64 has formed therein a central hole 67 extending in the axial direction and being open to the spring chamber 66, and a cylinder chamber 68 being open to the side of the plug 63. A valve seat 61*a* with which the pilot poppet valve 61 comes into contact is formed at an opening end of the central bore 67 on the side adjacent to the spring chamber 66, and the pilot poppet valve 61 is pressed by the pilot spring 65 to be held against the valve seat 61*a*.

A piston 69 having a small-diameter shaft portion 69*a* is slidably fitted to the central hole 67 formed in the sleeve 64, and a piston 70 is slidably fitted to the cylinder chamber 68. The piston 69 is made integrally with the poppet valve 61 such that the small-diameter shaft portion 69*a* is joined to the poppet valve 61. A space around the small-diameter shaft portion 69*a* is communicated via a small hole 71 with a circumferential groove 72 formed in an outer periphery of the sleeve 64, and further communicated with the back pressure chamber 42 in the main valve section 40 via a passage 73 formed in the end cover 31. Also, the spring chamber 66 is communicated with the second passage portion 19*b* of the actuator passage 19 via a passage 74 formed in the end cover 31 and the valve body 1. Accordingly, when the poppet valve 61 is opened (moved to the left as viewed in the drawing), the back pressure chamber 42 is communicated with the second passage portion 19*b* of the pilot passage 19, thereby producing a flow of the hydraulic fluid (pilot flow) via the first passage portion 19*a* of the pilot passage 19→the variable throttle 47→the back pressure chamber 42→the passage 73→the circumferential groove 72→the small hole 71→the space around the small-diameter shaft portion 69*a*→the spring chamber 66→the passage 74→the second passage portion 19*b*.

An end of the piston 69 on the side opposite to the small-diameter shaft portion is held in abutment with the piston 70 disposed in the cylinder chamber 68. On the outer side of the piston 70 nearer to plug 63, there is formed a pressure bearing chamber 75 for urging the piston 70 to the left as viewed in the drawing (in the direction to open the poppet valve 61). The pressure bearing chamber 75 is communicated with the pressure bearing chamber 34 on the side of the spool 16 through both a radial groove 76 formed in an end surface of the sleeve 64 and a gap 76*a* formed in the end cover 31 to surround the sleeve 64, so that the pilot pressure introduced to the pressure bearing chamber 34 is also simultaneously introduced to the pressure bearing chamber 75. A pressure bearing chamber 75*a* on the outer side of the piston 70 opposite to plug 63 is communicated with the reservoir port 15 via a small hole 78 and a circumferential groove 78*a* both formed in the sleeve 64 and then a passage 79 formed in the end cover 31 and the valve body 1. With such a construction, the pistons 69, 70 are driven by the pilot pressure acting to operate the spool 16 to the left as viewed in the drawing, thereby pressing the pilot poppet valve 61 in the direction to open. At this time, the pilot spring 65 normally urges the pilot poppet valve 61 in the direction to close against the pressing force of the pistons 69, 70.

In the foregoing, the back pressure chamber 42 and the variable throttle 47 in the main valve section 40 constitute proportional control means for controlling the opening of the seat valve 41 in proportion to the opening of the pilot poppet valve 61 of the pilot control section 60. The relief spring 51, the relief poppet valve 55, the inner passage 56, the pistons 57, 58 having the small-diameter portions 57*a*, 58*a*, and the cylinder chamber 59 in the main valve section 40 constitute relief control means for opening the seat valve 41 when the pressure in the first passage portion 19*a* of the actuator passage 19 exceeds the predetermined level set by the spring 51. The pilot spring 65, the pistons 69, 70, the pressure bearing chamber 75, and the passage 77 in the pilot control section 60 constitute pilot operating means for increasing the opening of the pilot poppet valve 61 depending on the stroke of the spool 16 in the direction toward the left as viewed in the drawing.

The above explanation has been made of the elements relating to the hydraulic cylinder C, and elements relating to other actuators are also likewise incorporated in the valve device B.

A description will now be made in detail, with reference to FIG. 3, of the relationship between the main valve section 40 and the pilot control section 60 of the non-leak valve 27, particularly the principles based on which the back pressure chamber 42 and the variable throttle 47 control the opening of the seat valve 41 in proportion to the opening of the pilot poppet valve 61, and the seat valve 41 is controlled in amount proportional to the amount by which the pilot poppet valve 61 is controlled.

Figure 2:
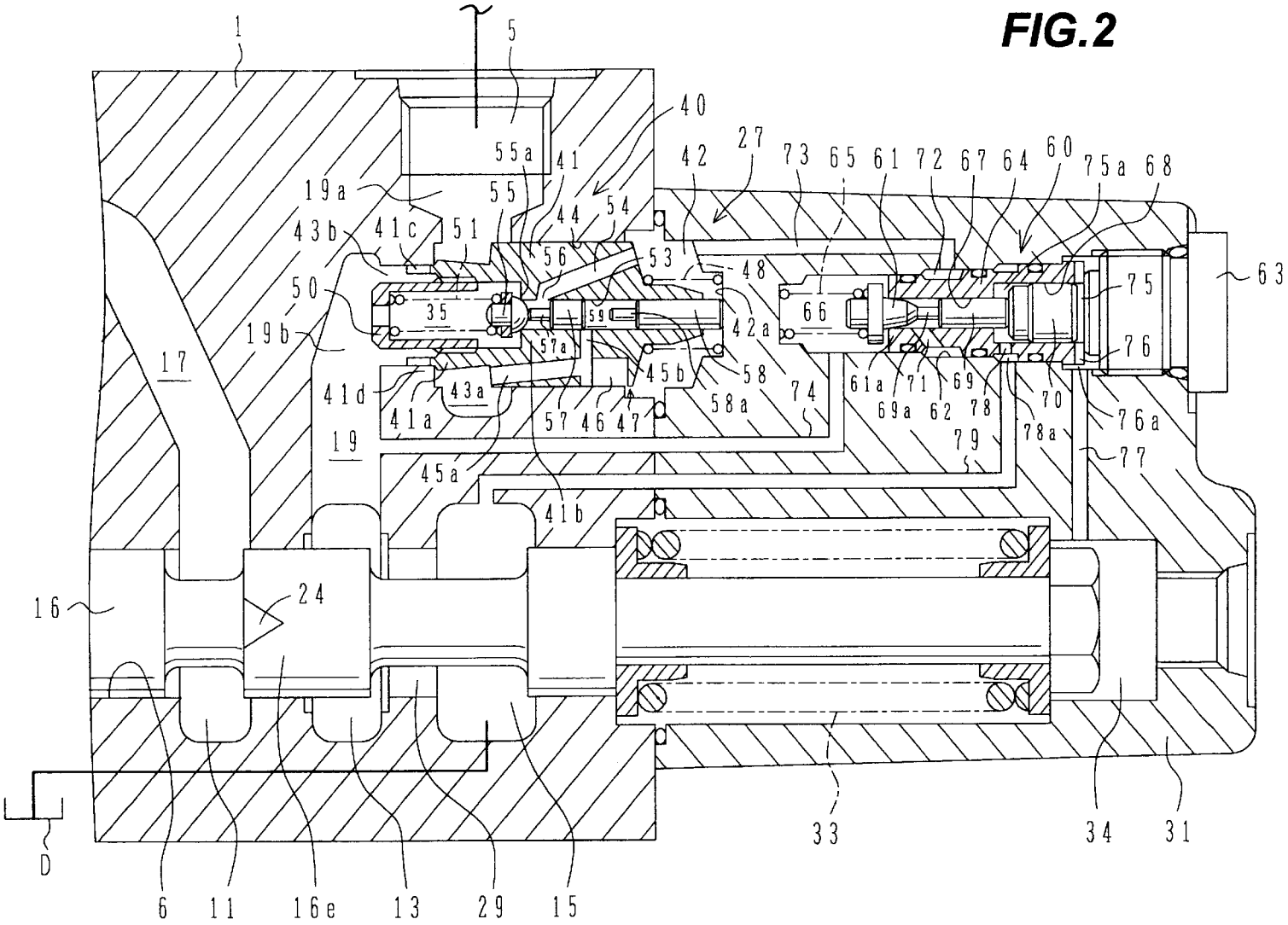
FIG. 2 is an enlarged view of a non-leak valve section of a valve device in the hydraulic control system shown in FIG. 1.
Figure 3:
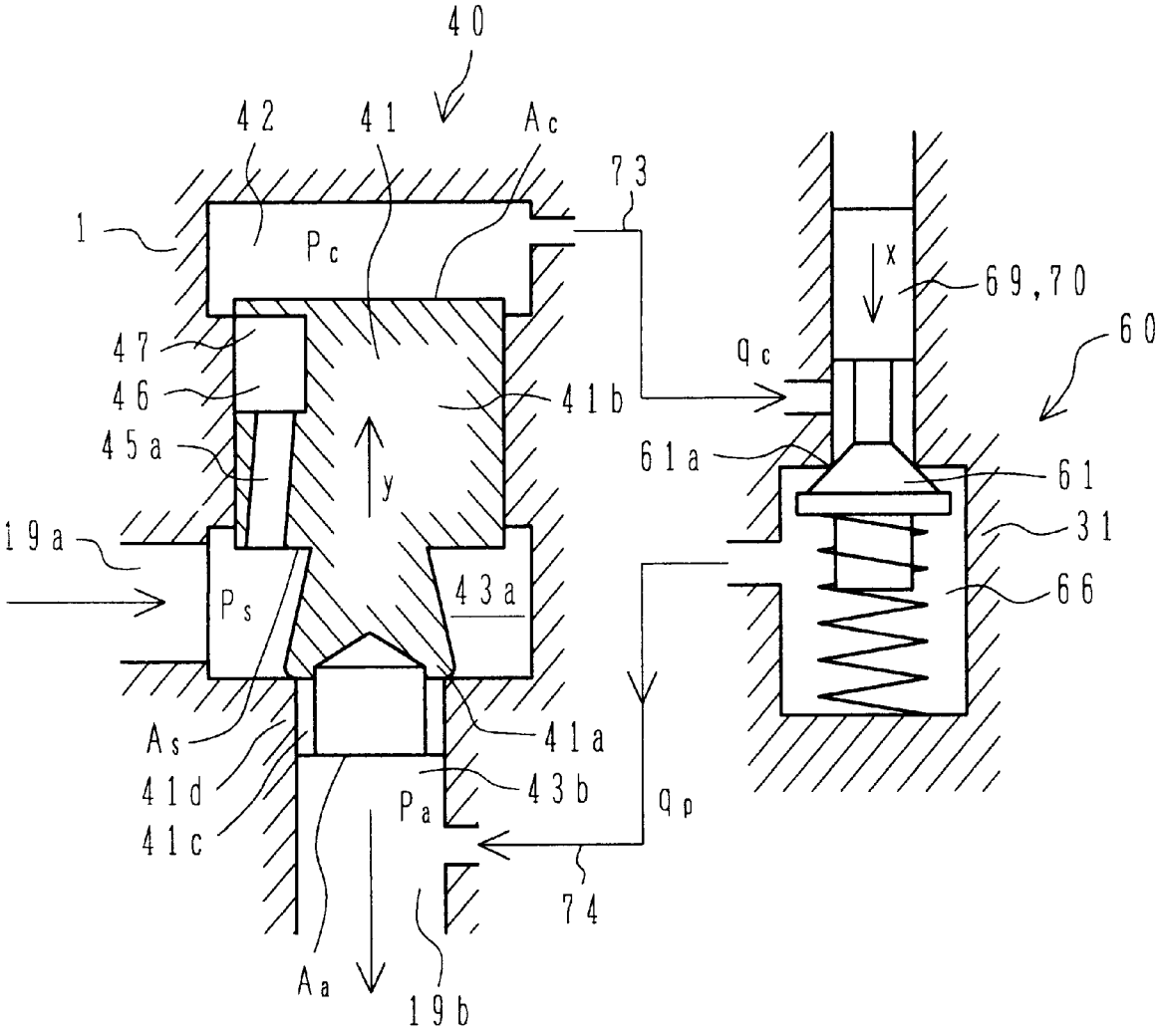
FIG. 3 is a representation for explaining that a seat valve of a non-leak valve in the present invention is controlled in amount proportional to the amount by which a pilot poppet is controlled.

FIG. 3 is a schematic representation of the non-leak valve 27 shown in FIGS. 1 and 2 with portions relating to the relief control means omitted from FIG. 3. The equivalent portions as those shown in FIGS. 1 and 2 are denoted by the same reference numerals.

In FIG. 3, the seat valve 41 of the main valve section 40 provided in the valve body 1 has a pressure bearing area As on the side adjacent to the inlet port 43*a*, and a pressure bearing area Aa on the side adjacent to the outlet port 43*b*. The metering orifice 41*c* with the predetermined slit width is formed in the seat portion 41*a* on the side adjacent to the outlet port 43*b*. The inlet port 43*a* is communicated with the back pressure chamber 42 formed on the rear side of the seat valve 41 through the passage 45*a* and the slit 46 both provided in the support portion 41*b*. The slit 46 cooperates with the valve body 1 to form the variable throttle 47 of which opening is changed depending on a displacement of the seat valve 41.

The back pressure chamber 42 is communicated through the passage 73 with the inlet side of the pilot poppet valve 61 of the pilot control section 60, and the outlet side of the pilot poppet valve 61 (the spring chamber 66) is communicated through the passage 74 with the outlet port 43*b* of the seat valve 41.

When the seat valve 41 is closed, it is pressed by the hydraulic pressure in the back pressure chamber 42 and the communication between the inlet port 43*a* and the outlet port 43*b* of the seat valve 41*b* is cut off by the seat portion 41*a* held into contact with the valve seat 41*d*. Simultaneously, the communication between the back pressure chamber 42 and the outlet port 43*b* is also cut off by the pilot poppet valve 61 held into contact with the valve seat 61*a*.

It is now assumed that the pilot poppet valve 61 is operated by introducing the pilot pressure to act on the pistons 69, 70 of the pilot control section 60. Given that the shift amount (displacement) by which the poppet valve 61 is operated in this case is x, a flow rate qp of the hydraulic fluid passing through the poppet valve 61 is expressed by:

$$qp = Cp \cdot Wp \cdot x\sqrt{(2g/r)\cdot(Pc - Pa)} \tag{1}$$

In the above formula, Cp is the coefficient of flow rate, Wp is the equivalent orifice width of the pilot poppet valve 61, g is the acceleration of gravity, r is the specific weight of the liquid, Pc is the pressure in the back pressure chamber 42, and Pa is the pressure at the outlet port 43*b* of the seat valve 41.

Assuming that the seat valve 41 is displaced y at this time, a flow rate qc of the hydraulic fluid passing through the variable orifice 47 provided in the slit 46 is expressed by:

$$qc = Cc \cdot Wc \cdot y\sqrt{(2g/r)\cdot(Ps - Pc)} \tag{2}$$

In the above formula, Cc is the coefficient of flow rate, Wc is the width of the slit 46, and Ps is the pressure at the inlet port 43*a* of the seat valve 41.

Since the relation of qp=qc holds in the condition where the seat valve 41 is brought into a rest, the displacement y of the seat valve 41 with respect to the shift amount x of the pilot poppet valve 61 is expressed by the following formula (3):

$$y = Cp \cdot Wp \cdot x\sqrt{Pc - Pa} \,/\, Cc \cdot Wc \cdot \sqrt{Ps - Pc} \tag{3}$$

Meanwhile, according to Journal (B) of the Japan Society of Mechanical Engineers, Vol. 53, No. 4910, (1987–6), pp. 1750–1755, for example, the fluid pressure acting on the seat valve 41 is very small in the valve structure shown in FIG. 3 and the hydraulic balance of the seat valve 41 is expressed by the following formula (4):

$$AsPs+AaPa=AcPc \tag{4}$$

On the other hand, the relation of the following formula (5) holds among the pressure bearing areas As, As and Ac:

$$Aa=Ac-As \tag{5}$$

By putting the above relation in the formula (4) and rearranging it after replacement of As/Ac=Kam, the following formula (6) is obtained:

$$Kam \cdot Ps+(1-Kam)Pa=Pc \tag{6}$$

By determining (Pc−pa) and (Ps−pc) in the formula (3) based on the relation of the above formula (6), the following formulae (7) and (8) are resulted:

$$(Pc-Pa)=Kam(Ps-Pa) \tag{7}$$

$$(Ps-Pc)=(1-Kam)(Ps-Pa) \tag{8}$$

By rewriting the formula (3) with the above formulae (7) and (8), the following formula (9) is obtained:

$$y = Cp \cdot Wp \cdot x\sqrt{Kam} \,/\, Cc \cdot Wc\sqrt{1 - Kam} \tag{9}$$

As seen from the above formula (9), the displacement y of the seat valve 41 is controlled depending on the shift amount (displacement) x of the pilot poppet valve 61 in proportional relation.

It is thus understood that the back pressure chamber 42 and the variable throttle 47 in the main valve section 40 can control the opening of the seat valve 41 of the main valve section 40 in proportion to the opening of the pilot poppet valve 61 of the pilot control section 60, and the seat valve 41 is controlled in amount proportional to the amount by which the pilot poppet valve 61 is controlled.

Next, the operation of the hydraulic control system of this embodiment will be explained with reference to FIGS. 1, 2 and 4 to 11.

1. Neutral State of Spool 16 (FIGS. 1, 2 and 4 to 7)

a) State of Holding Load of Hydraulic Cylinder C (FIGS. 1 and 2)

A description will be made of that the load of the hydraulic cylinder C is held when the spool 16 is in the neutral position, with reference to FIGS. 1 and 2.

When the spool 16 is in the neutral position, the pressure for holding the load to which the bottom side of the hydraulic cylinder C is subject acts on the space around the small-diameter shaft portion 69*a* of the piston 69 integral with the pilot poppet 61 via the external actuator port 5→the first passage portion 19*a* of the actuator passage 19 (the inlet port 43*a*)→the slit 46→the variable throttle 47→the back pressure chamber 42→the passage 73→the circumferential groove 72→the small hole 71. At this time, however, since the spool 16 is in the neutral state and the pressure in the pressure bearing chamber 34 on the side of the spool 16 is also almost equal to the reservoir pressure, the pressure bearing chamber 75 on the pilot side is similarly under the reservoir pressure and no force for driving the pilot poppet valve 61 is developed on the piston 70. Also, with the small-diameter shaft portion 69*a* of the piston 69 integrally joined to the pilot poppet valve 61, although the load pressure on the bottom side of the hydraulic cylinder C acts on the space around the small-diameter shaft portion 69*a* through the back pressure chamber 42, forces acting on the pilot poppet valve 61 and the piston 69 due to that load pressure are balanced by each other, and the pilot poppet valve 61 is not opened even with that load pressure thus introduced. Accordingly, the pilot poppet valve 61 is held in the closed state and hence the seat portion 41*a* of the seat valve 41 of the non-leak valve 27 is held in the closed position.

Figure 4:
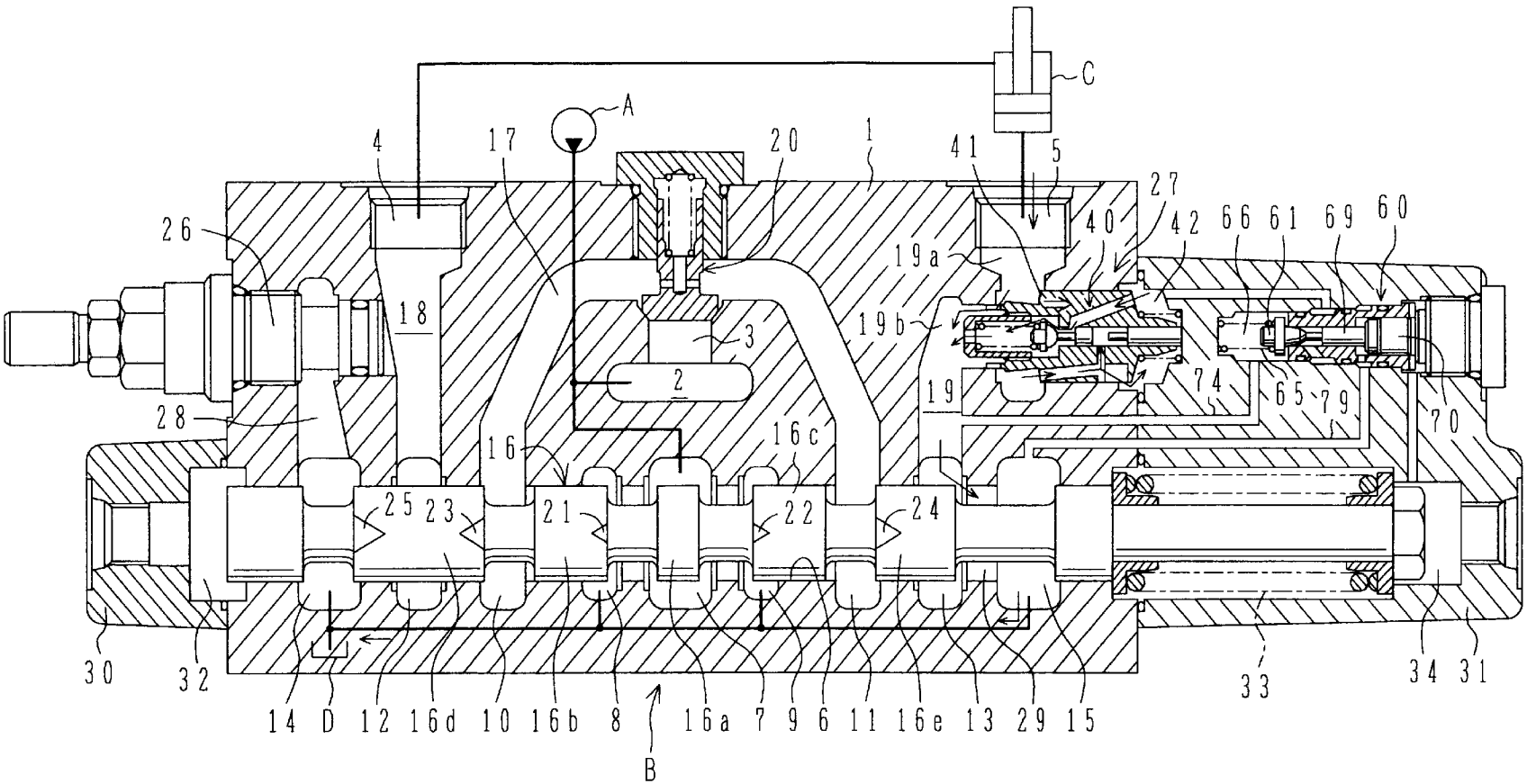
FIG. 4 is a view for explaining the operation of the hydraulic control system, shown in FIG. 1, in an overload state of the hydraulic cylinder.
Figure 5:
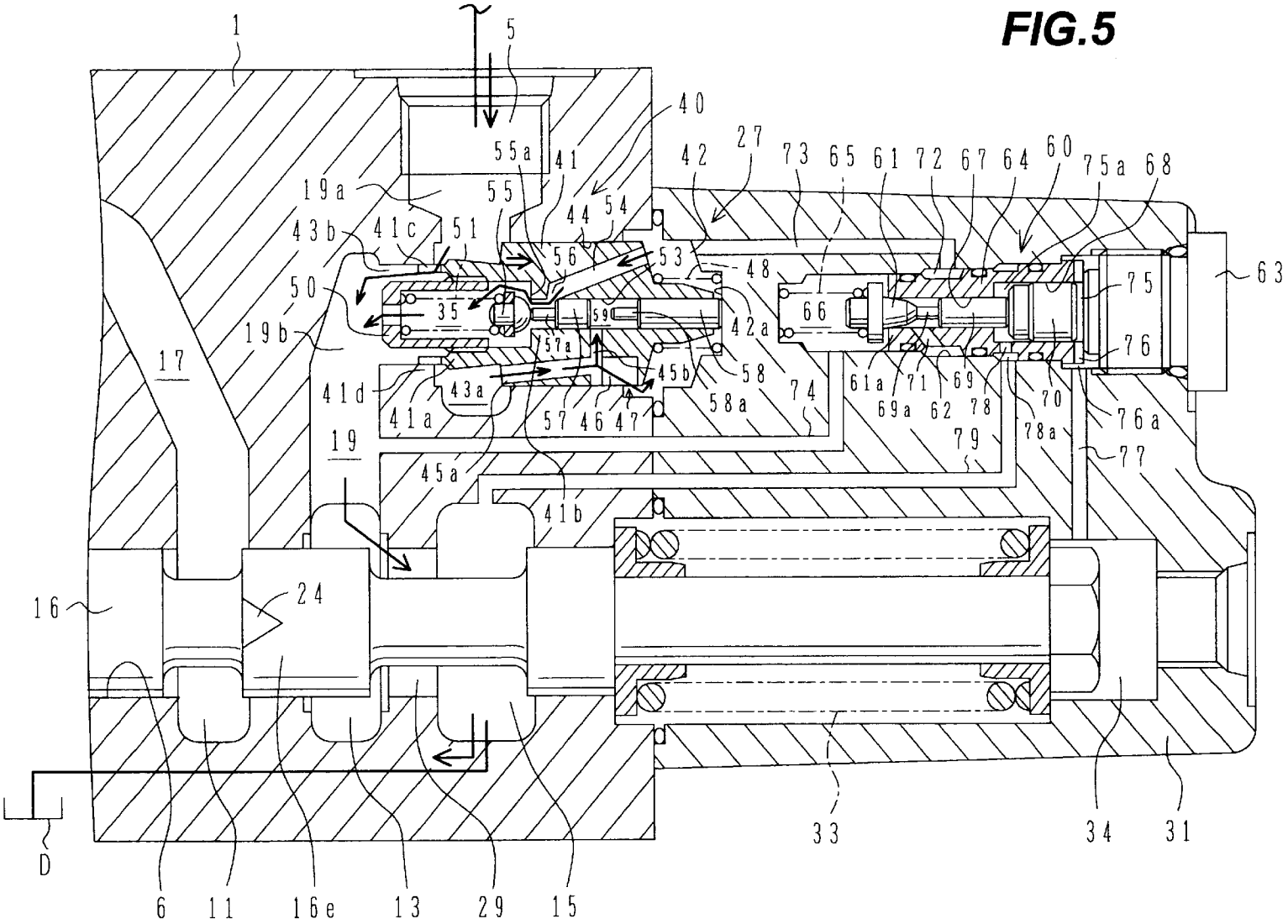
FIG. 5 is an enlarged view of the non-leak valve section of the valve device in the hydraulic control system shown in FIG. 4.

As explained above, when the spool 16 is in the neutral position, the communication between the external actuator port 5 and the internal actuator port 13 is cut off by the seat valve 41 of the non-leak valve 27, and no leakage of the hydraulic fluid occurs even with the load pressure acting on the hydraulic cylinder C, enabling the hydraulic cylinder C to be held in the same position. In other words, the non-leak valve 27 fulfills the load holding function.

b) Overload State of Hydraulic Cylinder C (FIGS. 4 and 5)

The operation in an overload state of the hydraulic cylinder C occurred when the spool 16 is in the neutral position will be described with reference to FIGS. 4 and 5. In these drawings, single-line arrows denote a flow of the hydraulic fluid and a double-line arrow denotes movement of the seat valve 41.

If the hydraulic cylinder C is subject to an abnormal overload acting on the external actuator port 5 in the downward direction when the spool 16 is in the neutral position, the high pressure in the external actuator port 5 acts on the piston 57 via the first passage portion 19*a* (the inlet port 43*a*)→the passages 45*a*, 45*b*→the cylinder chamber 59. Therefore, the relief poppet valve 55 is pressed by the piston 57 and moved to the left as viewed in the drawing against the relief spring 51, allowing the high pressure in the back pressure chamber 42 to be released to the reservoir D via the inner passage 56→the spring chamber 52→the second passage portion 19*b*→the internal actuator port 13→the communication passage 29→the reservoir port 15.

With such a release of the hydraulic fluid, there produces pressure across the variable throttle 47, i.e., a pressure difference between the external cylinder port 5 and the back pressure chamber 42. The pressure balance of the seat valve 41 is therefore lost, whereupon the seat valve 41 is moved to the right as viewed in the drawing and the seat portion 41*a* is opened.

Figure 6:
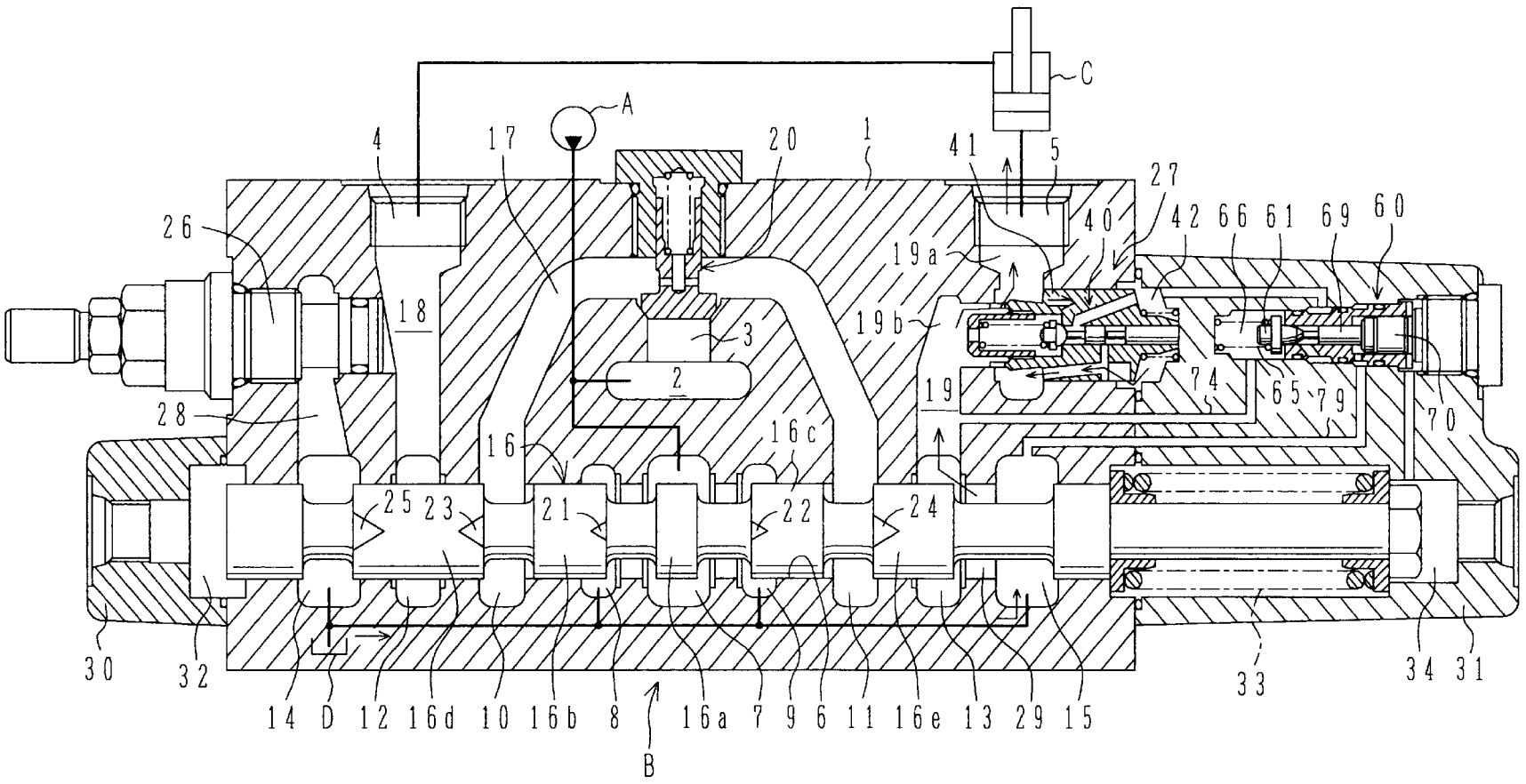
FIG. 6 is a view for explaining the operation of the hydraulic control system, shown in FIG. 1, in a negative pressure state of the hydraulic cylinder.
Figure 7:
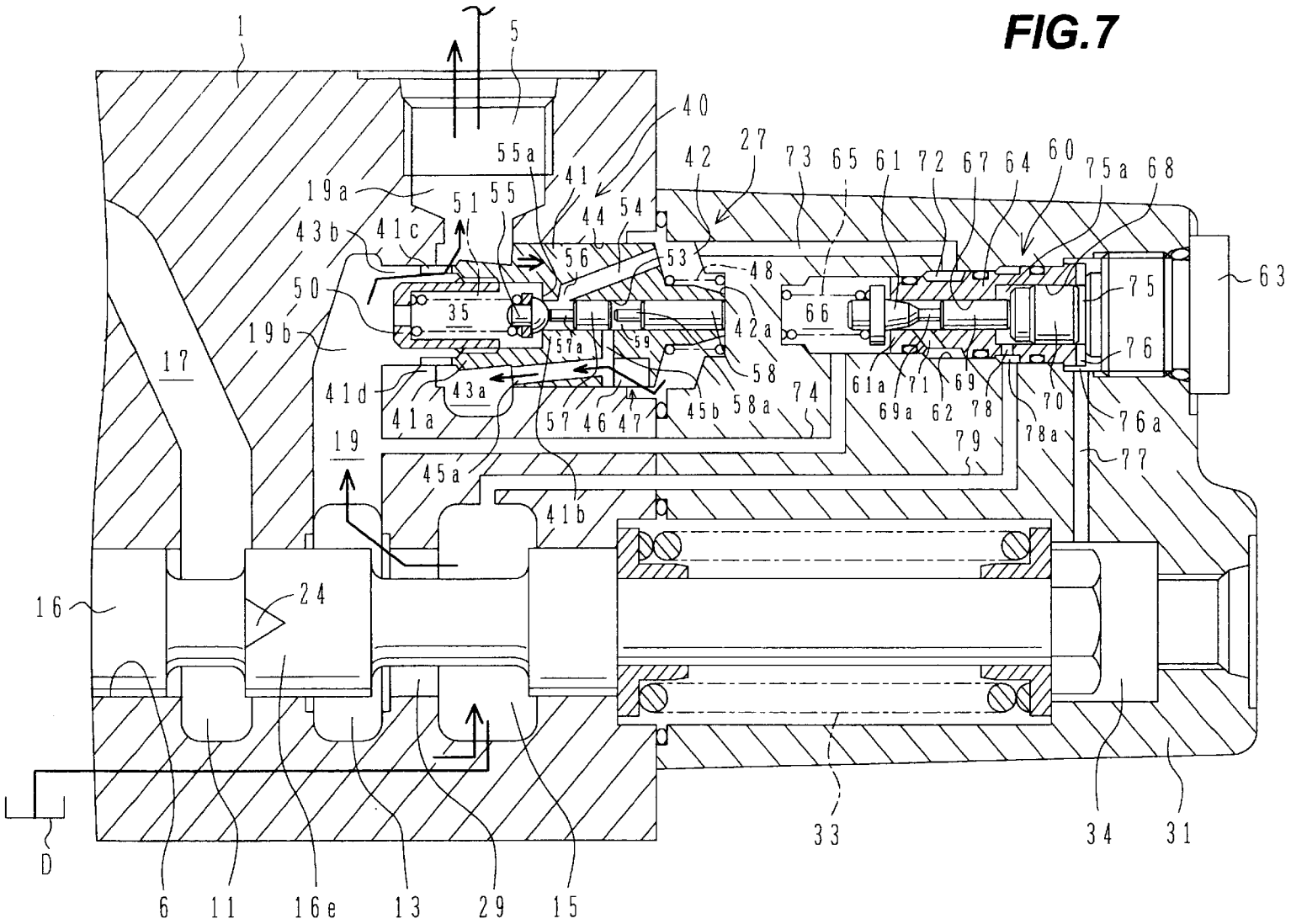
FIG. 7 is an enlarged view of the non-leak valve section of the valve device in the hydraulic control system shown in FIG. 6.

As a result, the high pressure in the hydraulic cylinder C is released to the reservoir D via the external actuator port 5→the actuator passage 19→the internal actuator port 13→the communication passage 29→the reservoir port 15. This prevents the hydraulic cylinder C from being damaged due to an overload. In other words, the non-leak valve 27 fulfills the overload relief function.

c) Negative Pressure State of Hydraulic Cylinder C (FIGS. 6 and 7 )

The operation in a negative pressure state of the hydraulic cylinder C occurred when the spool 16 is in the neutral position will be described with reference to FIGS. 6 and 7. In these drawings, single-line arrows denote a flow of the hydraulic fluid and a double-line arrow denotes movement of the seat valve 41.

If the hydraulic cylinder C is pulled upward to develop negative pressure on the bottom side thereof when the spool 16 is in the neutral position, the back pressure chamber 42 is also subject to negative pressure and the hydraulic pressure at the internal actuator port 13 communicating with the reservoir port 15 becomes relatively higher than the pressure in the back pressure chamber 42. The pressure balance of the seat valve 41 is therefore lost, whereupon the seat valve 41 is moved to the right as viewed in the drawing and the seat portion 41*a* is opened.

As a result, the hydraulic fluid is replenished from the reservoir D to the bottom side of the hydraulic cylinder C, which has been subject to negative pressure, via the reservoir port 15→the communication passage 29→the internal actuator port 13→the actuator passage 19→the external actuator port 5. This prevents the hydraulic cylinder C from being damaged due to cavitation etc. In other words, the non-leak valve 27 fulfills the make-up function.

Figure 8:
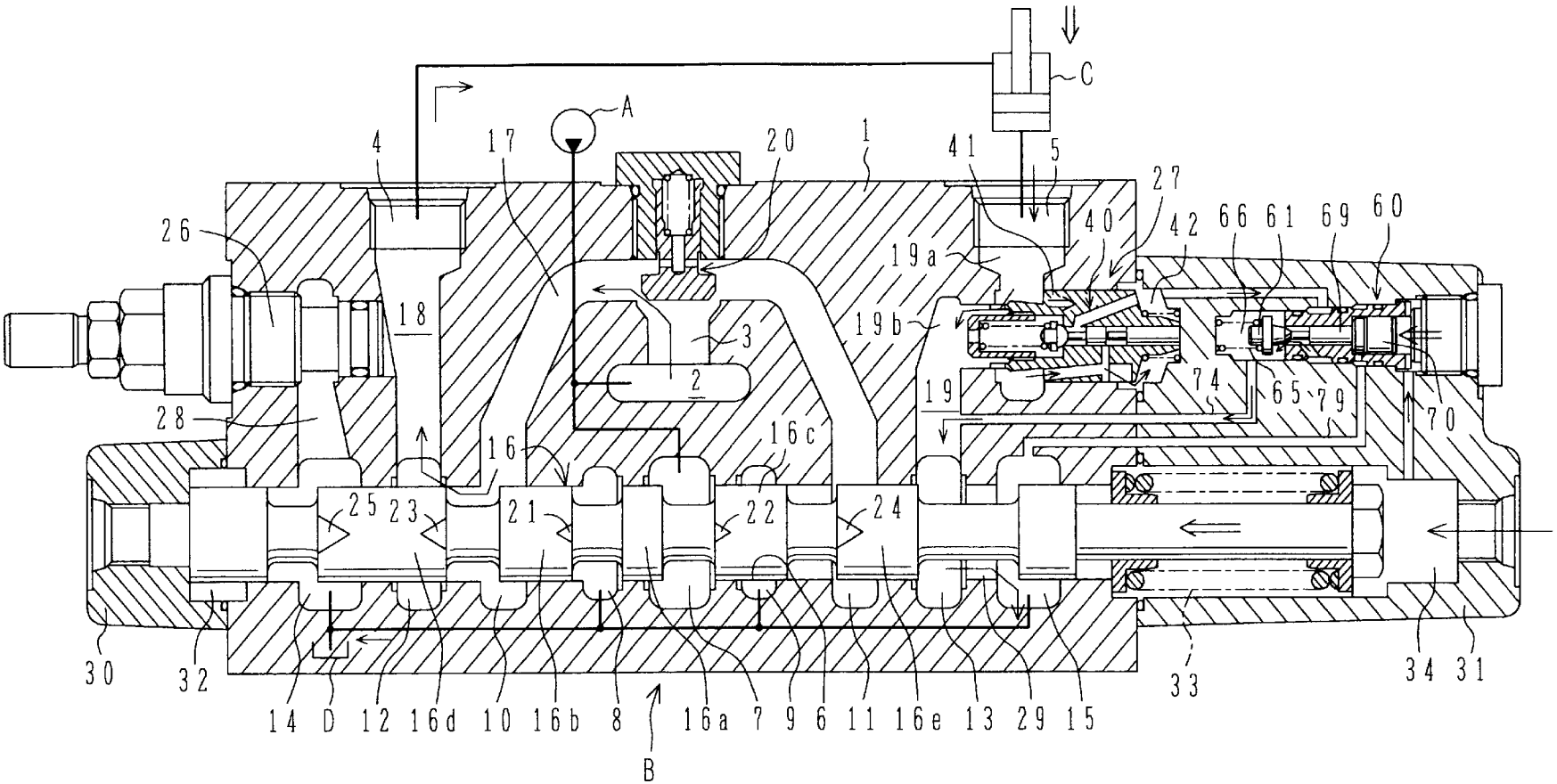
FIG. 8 is a view for explaining the operation of the hydraulic control system, shown in FIG. 1, upon contraction of the hydraulic cylinder.
Figure 9:
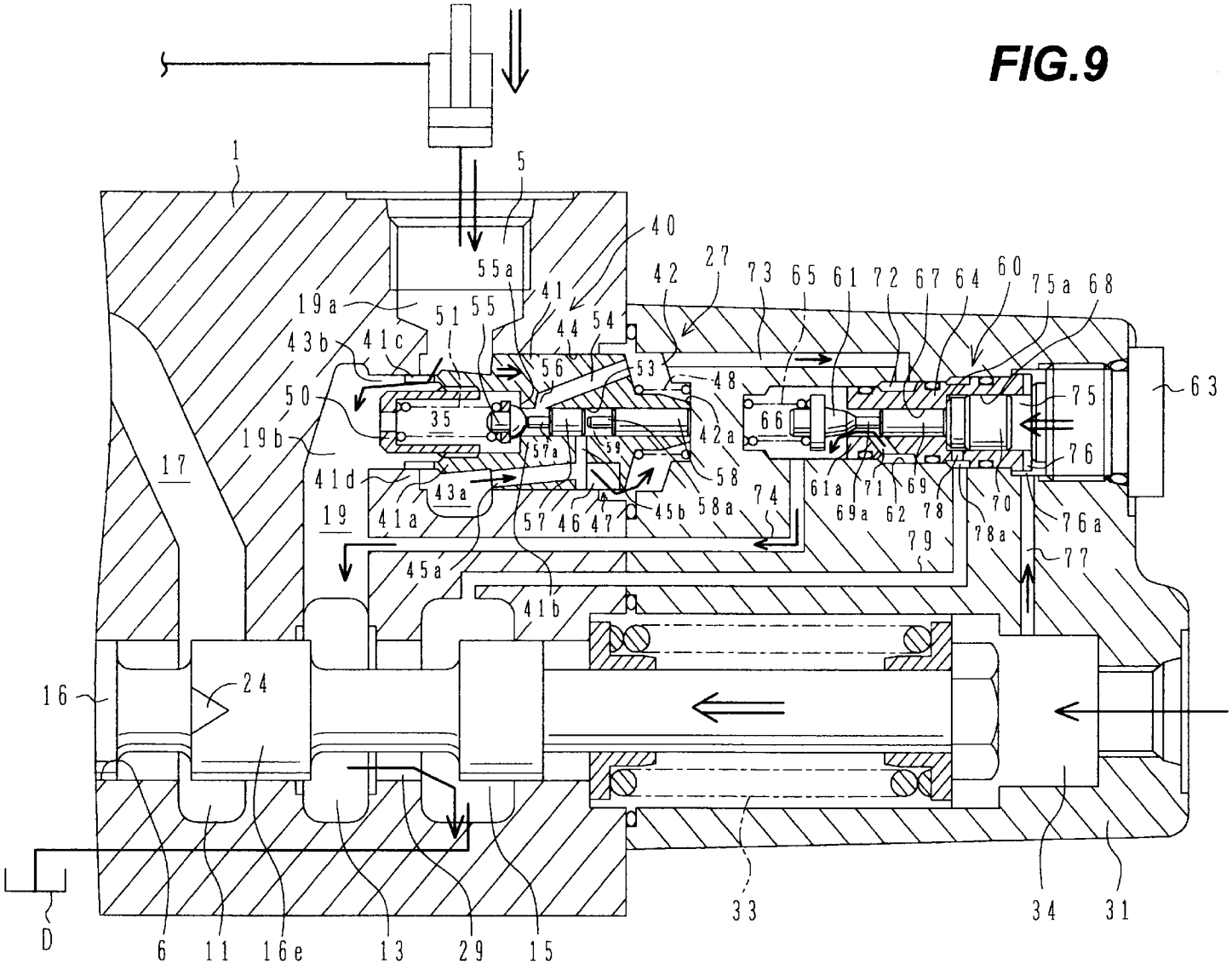
FIG. 9 is an enlarged view of the non-leak valve section of the valve device in the hydraulic control system shown in FIG. 8.

2. Upon Operation of Hydraulic Cylinder C (FIGS. 8–11)

a) Upon Contraction of Hydraulic Cylinder C (FIGS. 8 and 9 )

The operation upon contraction of the hydraulic cylinder C will be described with reference to FIGS. 8 and 9. In these drawings, single-line arrows denote flows of the hydraulic fluid and double-line arrows denote movement of the seat valve 41 and the piston 70.

When a hydraulic pilot valve (not shown) is operated for moving the spool 16 to the left as viewed in the drawing, the pilot pressure is introduced to the pressure bearing chamber 34 to press the spool 16, whereby the spool 16 is moved to the left as viewed in the drawing. Therefore, the meter-in variable throttle 23 of the spool 16 is opened to be communicated with the internal actuator port 12, and the hydraulic fluid delivered from the hydraulic pump A is supplied to the rod side of the hydraulic cylinder C through the meter-in variable throttle 23 while a flow rate of the supplied hydraulic fluid is controlled depending on the opening area of the meter-in variable throttle 23.

The hydraulic fluid returned from the bottom side of the hydraulic cylinder C acts on the space around the small-diameter shaft portion 69*a* of the piston 69 integral with the pilot poppet 61 via the external actuator port 5→the first passage portion 19*a* of the actuator passage 19 (the inlet port 43*a*)→the slit 46→the variable throttle 47→the back pressure chamber 42→the passage 73→the circumferential groove→the small hole 71. At this time, the pilot pressure for moving the spool 16 also acts on the pressure bearing chamber 75 in the pilot control section 60 of the non-leak valve through the passage 77. With the pilot pressure, the piston 70 presses the pilot poppet valve 61 against the spring 65, thereby moving it to the left as viewed in the drawing. Therefore, the hydraulic fluid in the space around the small-diameter shaft portion 69*a* integral with the pilot poppet valve 61 is forced to flow out toward the reservoir D via the spring chamber 66→the passage 74→the second passage portion 19*b* of the actuator passage 19→the internal actuator port 13→the communication passage 29→the reservoir port 15. Such a flow of the hydraulic fluid (pilot flow) produces pressure across the variable throttle 47, i.e., a pressure difference between the external cylinder port 5 and the back pressure chamber 42. The pressure balance of the seat valve 41 is therefore lost, whereupon the seat valve 41 is moved to the right as viewed in the drawing to a position where the pressure balance is established again, and the seat portion 41*a* is opened.

As a result, the external actuator port 5 and the internal actuator port 13 are communicated with each other, allowing the hydraulic fluid returned from the bottom side of the hydraulic cylinder C to be released to the reservoir D through the actuator passage 19.

Figure 10:
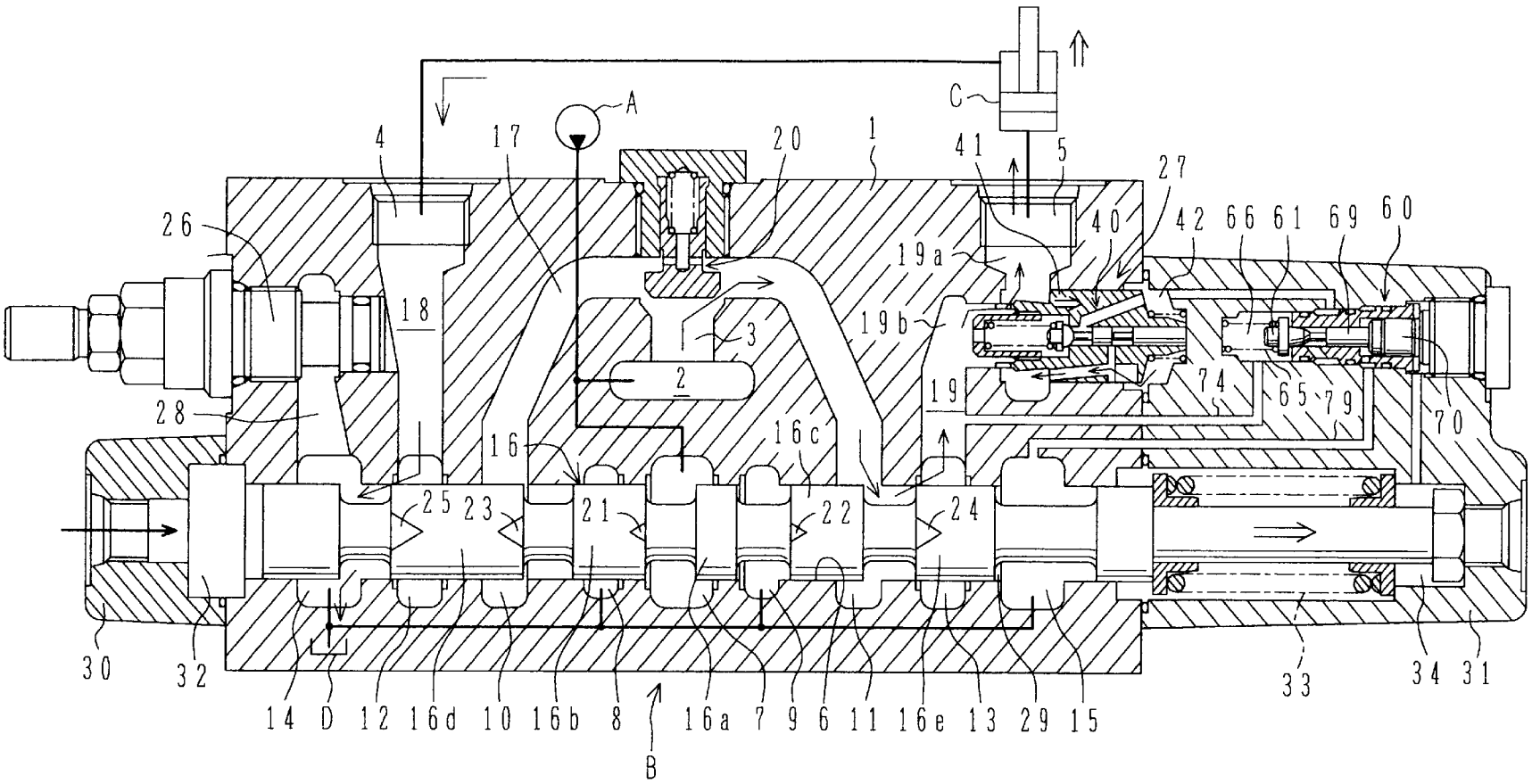
FIG. 10 is a view for explaining the operation of the hydraulic control system, shown in FIG. 1, upon extension of the hydraulic cylinder.
Figure 11:
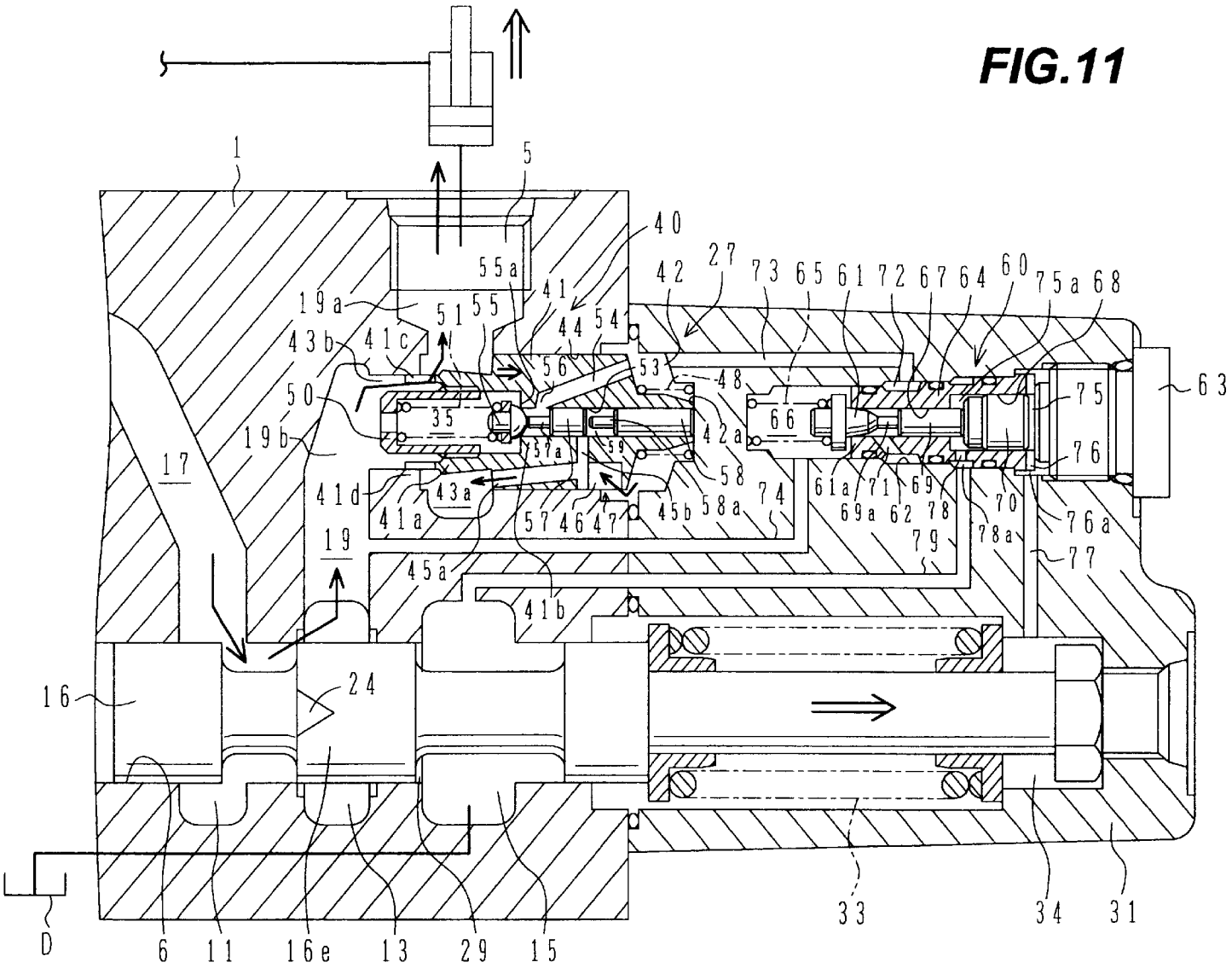
FIG. 11 is an enlarged view of the non-leak valve section of the valve device in the hydraulic control system shown in FIG. 10.

Here, since the amount of movement of the pilot poppet valve 61 is proportional to the pilot pressure and, as stated above, the amount of movement of the seat valve 41 is proportional to the amount of movement of the pilot poppet valve 61, the seat valve 41 is controlled to have the opening corresponding to the pilot pressure. The hydraulic fluid returned from the bottom side of the hydraulic cylinder C is therefore released to the reservoir D while a flow rate of the returned hydraulic fluid is controlled by the seat valve 41 of the non-leak valve 27. In other words, the non-leak valve 27 carries out meter-out flow rate control and, on the side of the spool 16, the hydraulic fluid merely passes through the communication passage 29.

b) Upon Extension of Hydraulic Cylinder C (FIGS. 10 and 11)

The operation upon extension of the hydraulic cylinder C will be described with reference to FIGS. 10 and 11. In these drawings, single-line arrows denote flows of the hydraulic fluid and double-line arrows denote movement of the seat valve 41.

When the hydraulic pilot valve (not shown) is operated for moving the spool 16 to the right as viewed in the drawing, the pilot pressure is introduced to the pressure bearing chamber 32 to press the spool 16, whereby the spool 16 is moved to the right as viewed in the drawing. Therefore, the meter-in variable throttle 24 of the spool 16 is opened to be communicated with the internal actuator port 13, and the hydraulic fluid delivered from the hydraulic pump A is supplied to the second passage portion 19*b* of the actuator passage 19 via the pump passage 2→the pump port 3→the passage bridge 17→the meter-in port 11→the meter-in variable throttle 24→the internal actuator port 13, while a flow rate of the supplied hydraulic fluid is controlled depending on the opening area of the meter-in variable throttle 24. The hydraulic fluid then reaches the outlet port 43*b* of the seat valve 41.

When the delivery pressure of the hydraulic pump A acts on the outlet port 43*b* of the seat valve 41, the force by which the acting pressure presses the seat valve 41 to the right as viewed in the drawing is larger than the force by which the pressure in the back pressure chamber 42 presses the seat valve 41 to the left as viewed in the drawing, whereupon the seat valve 41 is moved to the right as viewed in the drawing and the seat portion 41*a* is opened. Accordingly, the hydraulic fluid supplied to the second passage portion 19*b* of the actuator passage 19 through the meter-in variable throttle 24 and the internal actuator port 13 is further supplied to the bottom side of the hydraulic cylinder C through the first passage portion 19*a* and the external actuator port 5.

At the same time, the meter-in variable throttle 25 of the spool 16 is opened to be communicated with the reservoir port 14, and the hydraulic fluid returned from the rod side of the hydraulic cylinder C is allowed to flow out toward the reservoir D via the external actuator port 4→the actuator passage 18→the internal actuator port 12→the meter-out variable throttle 25→the reservoir port 15, while a flow rate of the flowing-out hydraulic fluid is controlled depending on the opening area of the meter-out variable throttle 25.

With this embodiment, as explained above, since the non-leak valve 27 fulfills the meter-out flow rate control function, the load holding function and the overload relief function for the hydraulic cylinder C, as well as the make-up function in the negative pressure state of the actuator, the valve device can be made more compact by arranging the non-leak valve and the spool in two lines.

One embodiment of the present invention has been above, but the illustrated embodiment can be modified in various ways within the spirit of the present invention. For example, while the non-leak valve 27 according to the present invention is provided only on the side of the pilot passage 19 and the conventional overload relief valve 26 is provided on the side of the pilot passage 18 in the above embodiment, a non-leak valve similar to the non-leak valve 27 may be provided on the side of the pilot passage 18 as well. In this case, the spool 16 is also modified such that the land 16*d* is formed to have a similar shape as the land 16*e* and a communication passage similar to the communication passage 29 is established between the internal actuator port 12 and the reservoir port 14.

Further, in the above embodiment, the pilot control section 60 of the non-leak valve 27 is disposed in the end cover 31 in which the spool operating spring 33 is disposed and the pressure bearing chamber 34 is defined. However, the end cover 31 may be one specific for the spool like a conventional end cover, and an end cover for the pilot control section 60 may be provided separately from the spool end cover.

Additionally, in the above embodiment, the spring chamber 65 in the pilot control section 60 is communicated with the second passage portion 19*b* of the pilot passage via the passage 74. However, because the second passage portion 19*b* serves as a low-pressure passage when the pilot poppet valve 61 is opened, the spring chamber 65 may be communicated with any other low-pressure passage, i.e., the reservoir port 15, other than the second passage portion 19*b*.

INDUSTRIAL APPLICABILITY

According to the present invention, the non-leak valve made up of the main valve section including the seat valve and the pilot control section including the pilot poppet valve fulfills not only the meter-out flow rate control function, but also the load holding function and the overload relief function for the hydraulic cylinder. Therefore, the valve device can be made more compact by arranging the non-leak valve and the spool in two lines.

We claim:

1. A hydraulic control system comprising a hydraulic pump (A), a valve device (B) for controlling a hydraulic fluid delivered from said hydraulic pump, and a hydraulic actuator (C) driven by the hydraulic fluid delivered from said hydraulic pump and controlled by said valve device, said valve device (B) comprising a valve body (1), a pump port (3) and a pair of external actuator ports (4, 5) all formed in said valve body and connected respectively to said hydraulic pump (A) and said actuator (C), a spool bore (6) formed in said valve body, a pair of internal actuator ports (12, 13) and a pair of reservoir ports (14, 15) all formed in an inner circumferential surface of said spool bore, a pair of actuator passages (18, 19) for connecting respectively said pair of external actuator ports to said pair of internal actuator ports, a spool (16) slidably fitted to said spool bore and switchingly controlling communication between said pump port and said pair of internal actuator ports, and a non-leak valve (27) disposed in at least one (19) of said pair of actuator passages in said valve body and controlling communication of said one actuator passage, said non-leak valve comprising a main valve section (40) including a seat valve (41) for dividing said one actuator passage (19) into a first passage portion (19*a*) on the side of said external actuator port (5) and a second passage portion (19*b*) on the side of said internal actuator port (13), and a pilot control section (60) including a pilot poppet valve (61) for controlling opening/closing of said seat valve of said main valve section, said pilot poppet valve (61) of said pilot control section (60) being opened in interlock relation when said spool (16) is operated in a first direction to communicate said pump port (3) with said internal actuator port (12) positioned in the other (18) of said pair of actuator passages, thereby opening said seat valve (41) of said main valve section (40) to establish communication between the first passage portion (19*a*) and the second passage portion (19*b*) of said one actuator passage, wherein:

said main valve section of said non-leak valve (27) comprises proportional control means (42, 47) for controlling an opening of said seat valve (41) in proportion to an opening of said pilot poppet valve (61), and relief control means (51, 55, 56, 57, 58, 57*a*, 58*a*, 59) for opening said seat valve when the pressure in the first passage portion of said one actuator passage exceeds a predetermined level, and said pilot control section (60) of said non-leak valve (27) comprises pilot operating means (65, 69, 70, 75, 77) for increasing the opening of said pilot poppet valve (61) depending on the stroke of said spool (16) in the first direction, said spool (16) being configured such that a communication passage (29) including no meter-out variable throttle is established between said internal actuator port (13) positioned on the side of said one actuator passage (19) and said reservoir port (15) adjacent to said internal actuator port (13) when said spool is in a neutral position and when said spool is operated in the first direction.

2. A hydraulic control system according to claim 1, wherein said proportional control means of said main valve section (40) comprises a back pressure chamber (42) for urging said seat valve (41) in the closing direction, and a proportional control variable throttle (47) provided between said seat valve and said valve body (1) for communicating the first passage portion (19*a*) of said one actuator passage (19) with said back pressure chamber (42) through a minimum opening when said seat valve is closed, and increasing the opening thereof depending on the stroke of the seat valve (41) in the opening direction, said pilot poppet valve (61) of said pilot control section (60) controlling communication between said back pressure chamber (42) and the low-pressure passage (19*b*).

3. A hydraulic control system according to claim 2, wherein said relief control means of said main valve section (40) comprises an inner passage (56) formed in the interior of said seat valve (41) for communicating the second passage portion (19*b*) of said one actuator passage (19) with said back pressure chamber (42), a relief poppet valve (55) disposed to open and close said inner passage, and an operating mechanism (51, 57, 58, 57*a*, 58*a*, 59) for holding said relief poppet valve in a closed position when the pressure in said first passage portion (19*a*) is lower than said predetermined level, and for opening said relief poppet valve when the pressure in said first passage portion (19*a*) exceeds said predetermined level.

4. A hydraulic control system according to claim 3, wherein said operating mechanism of said relief control means comprises pistons (57, 58) built in said seat valve (41) and driven by the pressure in said first passage portion (19*a*) to press said relief poppet valve (55) in the opening direction, a relief spring (51) disposed in a spring chamber (52), which is formed in said seat valve (41) on the side opposite to said back pressure chamber (42), for normally urging said relief poppet valve in the closing direction against the pressing force of said pistons, and a shaft portion (57*a*) positioned between said relief poppet valve (55) and said piston (57), a space around said shaft portion constituting part of said inner passage (56).

5. A hydraulic control system according to claim 2, wherein said pilot operating means of said pilot control section (60) comprises pistons (69, 70) driven by pilot pressure for operating said spool (16) in the first direction, thereby pressing said pilot poppet valve (61) in the opening direction, a pilot spring (65) disposed in a spring chamber (66), which is formed on the side opposite to said pistons, for normally urging said pilot poppet valve (61) in the closing direction against the pressing force of said pistons, and a shaft portion (69*a*) for joining said pilot poppet valve (61) and said piston (69) into a one-piece member, a space around said shaft portion being communicated with said back pressure chamber (42) in said main valve section (40), said spring chamber (66) being communicated with said low-pressure passage (19*b*).

6. A hydraulic control system according to claim 1, further comprising an end cover (31) attached to an end of said valve body (1) on the side of said one actuator passage (19) and having a first pressure bearing chamber (34) in which a spring (33) for holding said spool (16) in the neutral position is disposed and to which the pilot pressure for operating said spool (16) in the first direction is introduced, wherein said pilot control section (60) of said non-leak valve (27) is built in said end cover (31), and said pilot operating means (65, 69, 70, 75, 77) of said pilot control section (60) includes a second pressure bearing chamber (75) communicating with said first pressure bearing chamber (34) and operating said pilot poppet valve (61).

7. A hydraulic control system according to claim 1, wherein said main valve section (40) and said pilot control section (60) of said non-leak valve (27) are arranged in series to each other and parallel to said spool (16).

8. A hydraulic control system according to claim 1, wherein said spool (16) is configured such that a meter-out variable throttle (25) is established between said internal actuator port (12) positioned on the side of said the other actuator passage (18) and said reservoir port (14) adjacent to said internal actuator port (12) when said spool is operated in a second direction opposed to the first direction.

* * * * *